US009909545B1

(12) United States Patent
Waisanen et al.

(10) Patent No.: US 9,909,545 B1
(45) Date of Patent: Mar. 6, 2018

(54) OUTBOARD MOTOR WITH SOUND ENHANCEMENT DEVICE AND METHOD FOR MODIFYING SOUNDS PRODUCED BY AIR INTAKE SYSTEM OF AN OUTBOARD MOTOR

(71) Applicant: Brunswick Corporation, Mettawa, IL (US)

(72) Inventors: Andrew S. Waisanen, Fond du Lac, WI (US); Jeffrey C. Etapa, Elkhart Lake, WI (US); Wayne M. Jaszewski, Jackson, WI (US); Jeffrey J. Broman, Slinger, WI (US); Brian J. Fregonese, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/219,617

(22) Filed: Jul. 26, 2016

(51) Int. Cl.

| | |
|---|---|
| ***F02M 35/12*** | (2006.01) |
| ***F02M 35/10*** | (2006.01) |
| ***B63H 20/00*** | (2006.01) |
| ***B63H 20/32*** | (2006.01) |
| ***F02B 61/04*** | (2006.01) |
| ***F02M 35/104*** | (2006.01) |

(52) U.S. Cl.
CPC ..... *F02M 35/10242* (2013.01); *B63H 20/001* (2013.01); *B63H 20/32* (2013.01); *F02B 61/045* (2013.01); *F02M 35/104* (2013.01)

(58) Field of Classification Search
CPC .. F02M 35/12; F02M 35/165; F02M 35/1294; B63H 20/32; B63H 2020/323
See application file for complete search history.

(56) References Cited

U.S. PATENT DOCUMENTS 4,522,602 A 6/1985 Okazaki
4,734,070 A 3/1988 Mondek
(Continued)

OTHER PUBLICATIONS

K.C. Colwell, Faking It: Engine-Sound Enhancement Explained, Car and Driver Website, Apr. 2012, available at http://www.caranddriver.com/features/faking-it-engine-sound-enhancement-explained-tech-dept, 7 pages.
(Continued)

*Primary Examiner* — Andrew Polay
(74) *Attorney, Agent, or Firm* — Andrus Intellectual Property Law, LLP

(57) ABSTRACT

An outboard motor includes an internal combustion engine powering the outboard motor and a cowl covering the engine and having a vent allowing air under the cowl. A throttle body meters flow of the air into the engine and an intake structure downstream of the throttle body delivers the metered airflow to one or more combustion chambers in a cylinder block of the engine. A sound enhancement assembly in acoustic communication with the intake structure collects sounds emitted by the engine. The sound enhancement assembly is configured to amplify a subset of the collected sounds that have frequencies within a desired frequency range. A method for modifying sounds produced by an air intake system of an internal combustion engine powering an outboard motor is also disclosed. The method includes positioning a sound enhancement assembly in acoustic communication with an air intake passageway located downstream of the engine's throttle body.

19 Claims, 6 Drawing Sheets

(56) References Cited

U.S. PATENT DOCUMENTS

| | | | | |
|---|---|---|---|---|
| 4,778,029 | A | 10/1988 | Thornburgh | |
| 4,846,300 | A | 7/1989 | Boda | |
| 5,083,538 | A | 1/1992 | Hubbell | |
| 6,647,956 | B1 | 11/2003 | Sharpton | |
| 6,722,467 | B1 | 4/2004 | Kusche et al. | |
| 6,830,024 | B2 | 12/2004 | Kodweiss et al. | |
| 6,932,189 | B2 | 8/2005 | Helber et al. | |
| 7,021,262 | B1 | 4/2006 | Belter et al. | |
| 7,188,703 | B2 | 3/2007 | Hofmann et al. | |
| 7,299,783 | B1 | 11/2007 | Broman et al. | |
| 7,350,496 | B2 | 4/2008 | Nakayama et al. | |
| 7,353,791 | B2 | 4/2008 | Sasaki et al. | |
| 7,448,353 | B2 | 11/2008 | Shinada et al. | |
| 7,621,370 | B2 | 11/2009 | Abe et al. | |
| 7,845,466 | B2 | 12/2010 | Kostun et al. | |
| RE42,490 | E | 6/2011 | Takeuchi et al. | |
| 7,967,106 | B2 | 6/2011 | Ross et al. | |
| 8,011,469 | B2 | 9/2011 | Olson | |
| 8,127,888 | B1 | 3/2012 | Mah | |
| 8,384,528 | B2 | 2/2013 | McCarthy et al. | |
| 8,651,906 | B1 * | 2/2014 | Morton | F02M 35/168 440/77 |
| 8,666,088 | B2 | 3/2014 | Khami et al. | |
| 8,684,132 | B2 | 4/2014 | Mullet et al. | |
| 8,776,755 | B2 | 7/2014 | Muller et al. | |
| 9,359,981 | B1 | 6/2016 | Waisanen et al. | |
| 9,429,117 | B2 | 8/2016 | Takahashi et al. | |
| 2005/0121254 | A1 | 6/2005 | Hofmann et al. | |
| 2005/0121255 | A1 | 6/2005 | Hofmann | |
| 2005/0133300 | A1 | 6/2005 | Hofmann | |
| 2007/0054569 | A1 | 3/2007 | Murai et al. | |
| 2007/0292281 | A1 * | 12/2007 | Sasaki | F02M 35/1294 417/269 |
| 2009/0078497 | A1 | 3/2009 | Ishizuka et al. | |
| 2011/0147116 | A1 | 6/2011 | Olson | |
| 2014/0055258 | A1 | 2/2014 | Grosse-Budde | |

OTHER PUBLICATIONS

Waisanen et al., Outboard Motor With Sound Enhancement Device and Method for Modifying Sounds Produced by Air Intake System of an Outboard Motor, Unpublished U.S. Appl. No. 15/091,007, filed Apr. 5, 2016.

* cited by examiner

OUTBOARD MOTOR WITH SOUND ENHANCEMENT DEVICE AND METHOD FOR MODIFYING SOUNDS PRODUCED BY AIR INTAKE SYSTEM OF AN OUTBOARD MOTOR

FIELD

The present disclosure relates to air intake systems for internal combustion engines associated with outboard motor propulsion systems.

BACKGROUND

U.S. Pat. No. 4,846,300, hereby incorporated by reference, discloses a marine engine with a multi-section injection-molded thermoplastic air box directing air to the fuel system's air intake throat and silencing engine noise emitted back through the throat. The air box has a cover section and a base section mounted to each other solely by a seal along a peripheral seam around the entire perimeter thereof, to prevent fuel leaks. The housing sections are preassembled to each other prior to mounting to the air intake throat. A removeable plug in the cover section allows access through the cover section to bolts mounting the base section to the throat. Access is also enabled to a fuel adjustment screw to enable adjustment, with the air box fully assembled and mounted in place on the throat, to enable adjustment under actual operating conditions. Air guide passages and an air plenum chamber are all molded in place.

U.S. Pat. No. 5,083,538, hereby incorporated by reference, discloses an air intake system for an internal combustion engine associated with the power head of an outboard marine propulsion system. The engine includes a vertical crank shaft and a flywheel mounted to the crank shaft above the engine block. An air manifold is mounted to the forward side of the engine, and includes an air inlet for receiving intake air. The air intake system includes an air flow path or duct defined by a series of walls, a rearwardly facing air intake opening, and a discharge opening for supplying intake air to the air manifold inlet. The engine is enclosed within a cowl assembly, and the air intake opening is located toward the upper end of the cowl assembly interior. The walls defining the air flow duct are formed integrally with a flywheel cover for facilitating assembly of the air flow duct to the engine. The air flow duct minimizes ingestion of water into the engine and reduces engine noise in the boat.

U.S. Pat. No. 9,359,981, hereby incorporated by reference, discloses an outboard motor including a system for enhancement of a first subset of sounds having a desired frequency, and a method for modifying sounds produced by an air intake system for an internal combustion engine powering the outboard motor. The method includes collecting sounds emitted in an area proximate a throttle body of the engine. A first subset of the collected sounds, which have frequencies within desired frequency range, is then amplified. The amplified first subset of sounds is then transmitted to an area outside a cowl covering the engine.

Unpublished U.S. patent application Ser. No. 15/091,007, filed Apr. 5, 2016, and hereby incorporated by reference, discloses an outboard motor including an internal combustion engine and a cowl covering the engine. An air vent allows intake air into the cowl, an air intake duct routes the intake air from the air vent to the engine, and a throttle body meters flow of the intake air from the air intake duct into the engine. A sound enhancement device is located proximate the throttle body. A sound duct is provided, and has an inlet end located proximate the sound enhancement device and an outlet end located proximate an outer surface of the cowl. The sound enhancement device is tuned to amplify a first subset of sounds having a desired frequency that are emitted from the throttle body, and the sound duct transmits the amplified sounds to an area outside the cowl. A method for modifying sounds produced by an air intake system of an outboard motor is also provided.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, an outboard motor includes an internal combustion engine powering the outboard motor and a cowl covering the engine and having a vent allowing air under the cowl. A throttle body meters flow of the air into the engine and an intake structure downstream of the throttle body delivers the metered airflow to one or more combustion chambers in a cylinder block of the engine. A sound enhancement assembly including an assembly housing is in acoustic communication with the intake structure and collects sounds emitted by the engine. The sound enhancement assembly is configured to amplify a subset of the collected sounds that have frequencies within a desired frequency range.

Another example of the present disclosure includes a method for modifying sounds produced by an air intake system of an internal combustion engine powering an outboard motor. The method includes positioning a sound enhancement assembly including an assembly housing in acoustic communication with an air intake passageway located downstream of a throttle body of the engine. The method also includes tuning a sound enhancement device of the sound enhancement assembly so that the sound enhancement device amplifies a subset of sounds emitted by the engine that have frequencies within a desired frequency range. The amplified subset of sounds is transmitted as sound pressure pulses through a sound passageway of the sound enhancement assembly to an area outside a cowl covering the engine. Fluid communication between the air intake passageway and the sound passageway is prevented.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
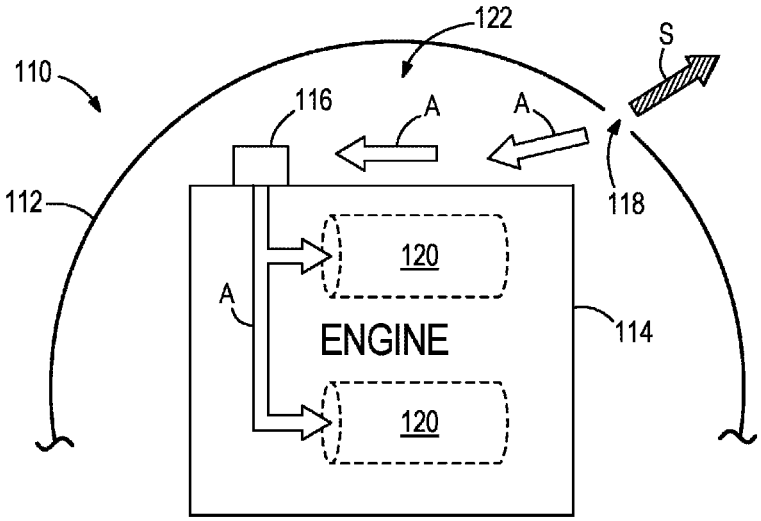
FIG. 1 PRIOR ART
FIG. 1 illustrates one example of a prior art outboard motor air intake system.

FIG. 1 is a simplified schematic illustrating a prior art outboard motor 110 including a cowl 112 covering an internal combustion engine 114. As is known, the engine 114 powers a propeller of the outboard motor 110, via a series of connections and gears that couple a crankshaft of the engine 114 to a propeller shaft. A throttle valve located in a throttle body 116 meters intake of air into the engine's combustion chambers 120, where the air is mixed with fuel and ignited in order to drive the engine's pistons, which movement causes the crankshaft to rotate. Air is provided to the interior of the cowl 112 through an air vent 118, which is shown as a simple hole extending through the cowl 112. However, it should be understood that the air vent 118 can have a flap, shield, or passage labyrinth provided over or around it in order to prevent rain or water from entering the cowl 112.

In the system shown in FIG. 1, air enters through the air vent 118 and, as shown by the arrows labeled "A," flows through the open under-cowl environment 122 toward the throttle body 116, where it then flows past the throttle valve contained therein and into the combustion chambers 120 of the engine 114. The throttle valve can be either electronically or manually actuated. Sound produced by the engine 114, including sound produced by the air intake system (for example due to flow of air past the throttle valve in the throttle body 116 or flow of air from an intake manifold into intake passages leading into combustion chambers 120) leaves the cowl 112 through the same vent 118, as shown by the arrow labeled "S." Mechanical noise from the engine 114 is also transmitted out of this vent 118, which is often located on the aft end or the side of the cowl 112 in order to transmit the noise away from the operator of the marine vessel to which the outboard motor 110 is coupled. In certain outboard motors, the air intake system is provided with a silencer that attenuates the noise produced by the air intake system, such as described in U.S. Pat. Nos. 4,846,300 and 5,083,538, incorporated herein above. Other components, such as an intake duct that acts as a resonator, may be attached to the vent 118 and/or throttle body 116. The design of such a resonator is typically optimized to balance tradeoffs between performance of the engine 114, packaging of the engine 114 and its components within the cowl 112, and noise vibration and harshness (NVH) characteristics.

Product noise requirements and/or expectations of a given outboard motor can vary greatly depending on the application. For example, performance boaters may desire a louder and/or more powerful sound quality than recreational boaters. However, expectations for sound quality and refinement are universal, and dictated in some geographical areas by law, regardless of the noise level expectations of the customer. The system and method of the present disclosure, described below with respect to FIGS. 2-7, enhance the powerful, desirable sound characteristics of an outboard motor without sacrificing the requirements and/or expectations for refinement of unpleasant sound.

Figure 2:
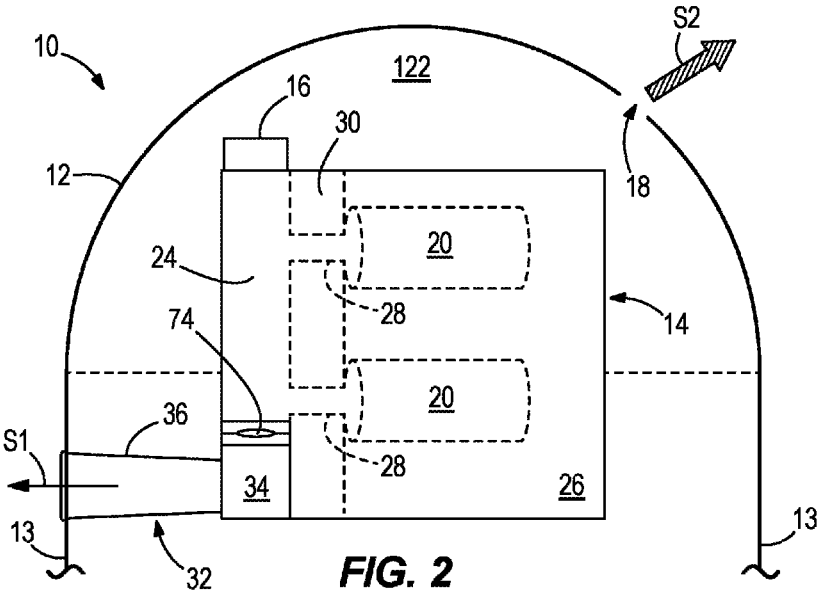
FIG. 2 illustrates one example of an outboard motor according to the present disclosure.

The outboard motor 10 of the present disclosure, shown in FIG. 2, has the same components as that of the outboard motor 110 of FIG. 1, but also includes a sound enhancement assembly 32, as will be described. The outboard motor 10 comprises an internal combustion engine 14 powering the outboard motor 10. A cowl having an upper portion 12 and a lower portion 13 covers the engine 14 and has a vent 18 that allows air under the cowl 12, 13. A throttle body 16 meters flow of air into the engine 14. An intake structure 24 is located downstream of the throttle body 16. The intake structure 24 can be or include any one or more of the following: an intake plenum, an intake manifold, intake runners, a surge tank, or any other combination of pipes and/or chambers. The intake structure 24 delivers the metered air flow from the throttle body 16 to one or more combustion chambers 20 in a cylinder block 26 of the engine 14. For example, the intake structure 24 can be in fluid communication with intake passages 28 extending through cylinder head 30 of the engine 14. Many such arrangements for the engine 14 are well known in the art and will therefore not be described further herein. The engine 14 could be any type/configuration of engine, including but not limited to an in-line engine or a V-type engine, and including any number of cylinders known to those having ordinary skill in the art.

A sound enhancement assembly 32 is provided in the outboard motor 10. The sound enhancement assembly 32 is in acoustic communication with the intake structure 24 and collects sounds emitted by the engine 14, for example sounds emitted by air passing through the throttle body 16, through the intake passages 28, into the combustion chambers 20, etc. The sound enhancement assembly 32 is configured to amplify a subset of the collected sounds that have frequencies within a desired frequency range. As will be described further herein below, the sound enhancement assembly 32 includes an inlet pipe 34 coupled to or integral with the intake structure 24 that collects the sounds emitted by the engine 14. The sound enhancement assembly 32 also includes an outlet pipe 36 that transmits the amplified subset of the collected sounds to an area outside the cowl 12, 13. A specific example, which is not limiting on the present disclosure, will be described below.

Figure 3:
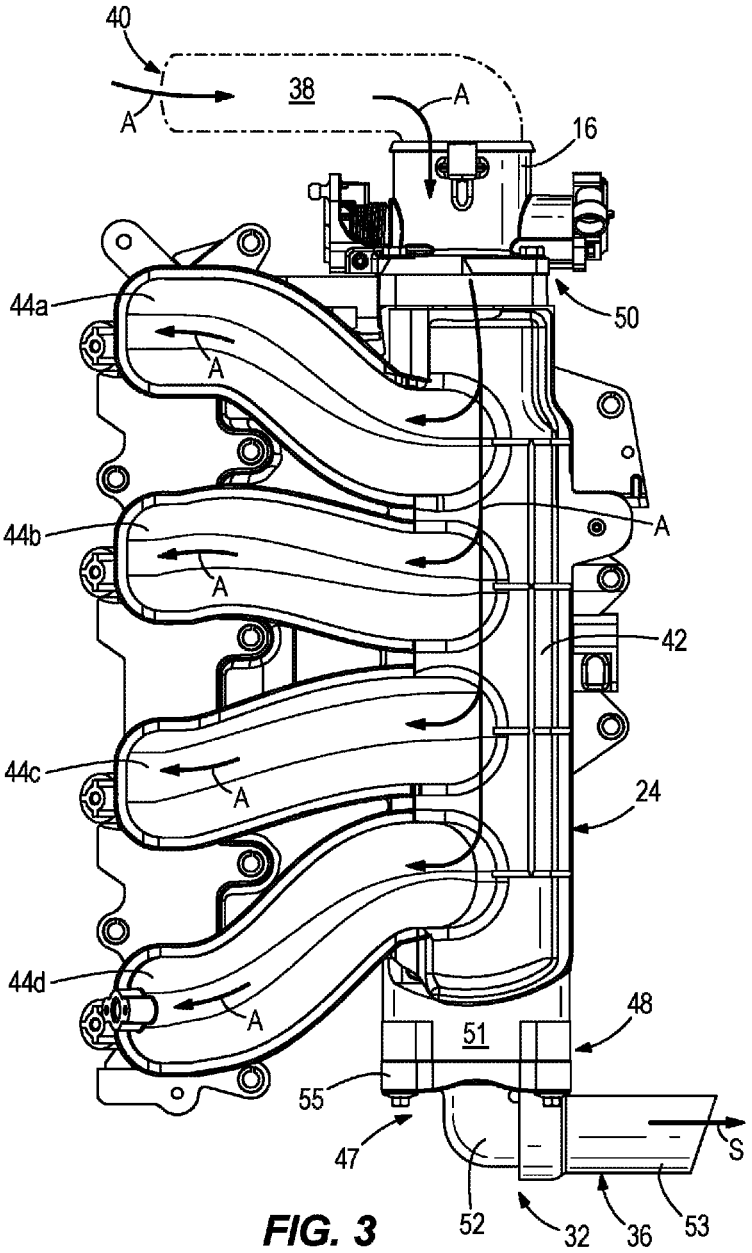
FIG. 3 illustrates one example of an air intake assembly and sound enhancement assembly according to the present disclosure.

Turning to FIG. 3, a side view of an air intake system for an internal combustion engine equipped with one example of a sound enhancement assembly 32 will be described. In this example, as opposed to the examples described with respect to FIGS. 1 and 2, the air intake system includes an air intake plenum or silencer, as shown at 38. An inlet end 40 of the silencer 38 can be directly connected to the vent 18 in the upper portion 12 of the cowl, or can be located proximate the vent 18. Air enters the inlet end 40 of the silencer 38 as shown by the arrow labeled "A" and travels through the silencer 38 into the throttle body 16. Air then continues into the intake structure 24 from its upper end 50, to which the throttle body 16 is coupled. In this example, the intake structure 24 includes a plenum 42 (e.g. intake manifold) and four intake runners 44*a*-44*d* connected to the plenum 42. After air enters the plenum 42, it travels along each of the intake runners 44*a*-44*d* to the cylinder head 30 (FIG. 2) and into, in this instance, four combustion chambers 20. The plenum 42 may be coupled to the cylinder block 26, a crank case cover, or another part of the engine 14. Here, the sound enhancement assembly 32 includes an assembly housing 47 that is coupled to a lower end 48 of the plenum 42 and is in acoustic communication with the intake structure 24. However, the sound enhancement assembly 32 could be connected to the intake structure 24, including but not limited to the plenum 42 and runners 44*a*-44*d*, anywhere upstream of the cylinder head 30 of the engine 14. For example, the sound enhancement assembly 32 could be coupled to the runner 44*d*. As shown, sound collected from the engine 14 exits the sound enhancement assembly 32 as indicated by the arrow labeled "S."

Figure 4:
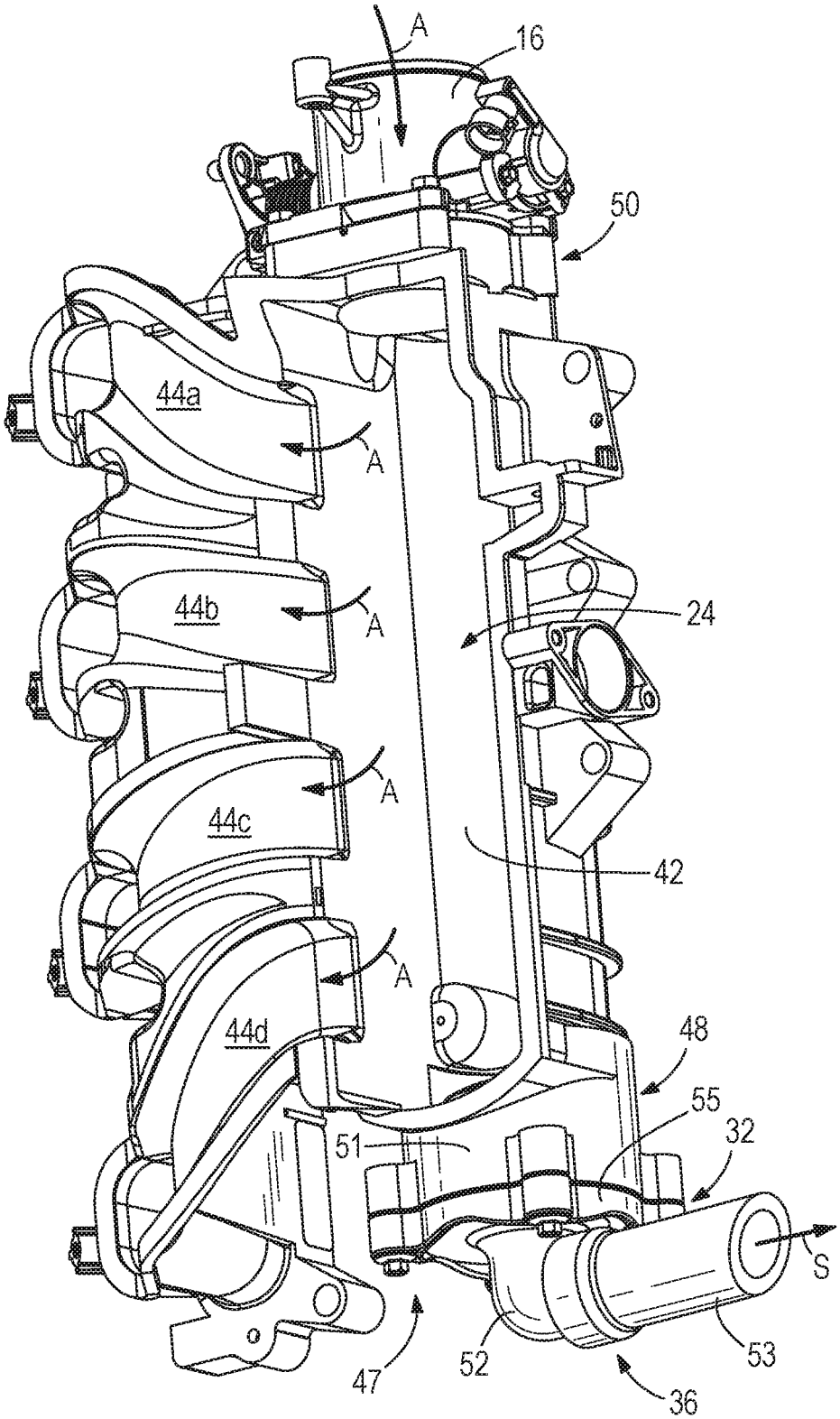
FIG. 4 illustrates portions of the assemblies described with respect to FIG. 3.

FIG. 4 illustrates a perspective view of the plenum 42 and the runners 44*a*-44*d*. The separate and distinct passageways for both air (labeled by the arrows A) and sound (labeled by the arrow S) are shown. The sound enhancement assembly 32 is also shown at a different angle, and includes the outlet pipe 36 and assembly housing 47. Referring to both FIGS. 3 and 4, the assembly housing 47 comprises a first mounting flange 51 (intake side) that is integral with the intake structure 24 and a second mounting flange 55 (outlet side) that is integral with an upstream end of the outlet pipe 36. More specifically, an elbow piece 52 serves as the upstream end for the outlet pipe 36 and comprises the integral flange 55 that connects the outlet pipe 36 to the first mounting flange 51 at the lower end 48 of the intake structure 24. The first and second mounting flanges 51, 55 are connected to one another in an airtight manner, as will be described herein below.

Figure 5:
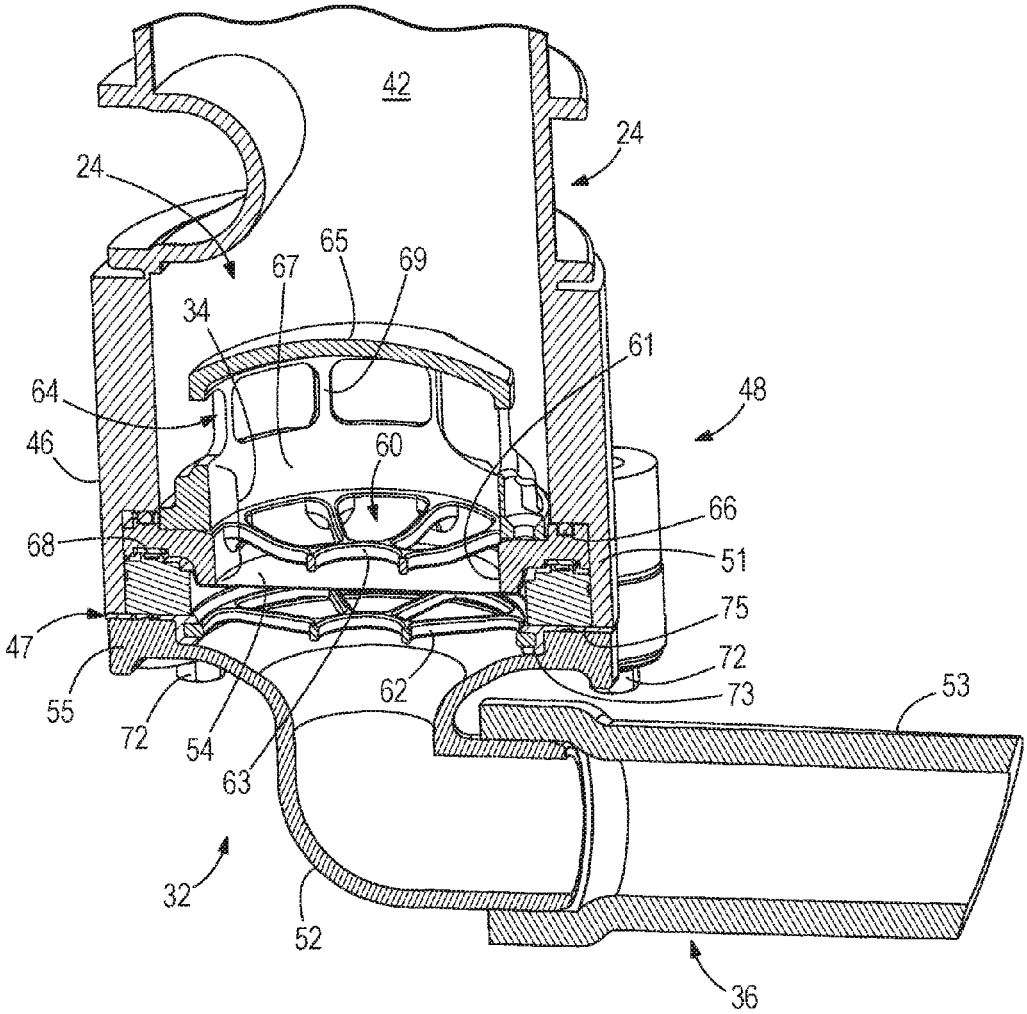
FIG. 5 illustrates an assembled cross-sectional view of a sound enhancement assembly according to the present disclosure.
Figure 6:
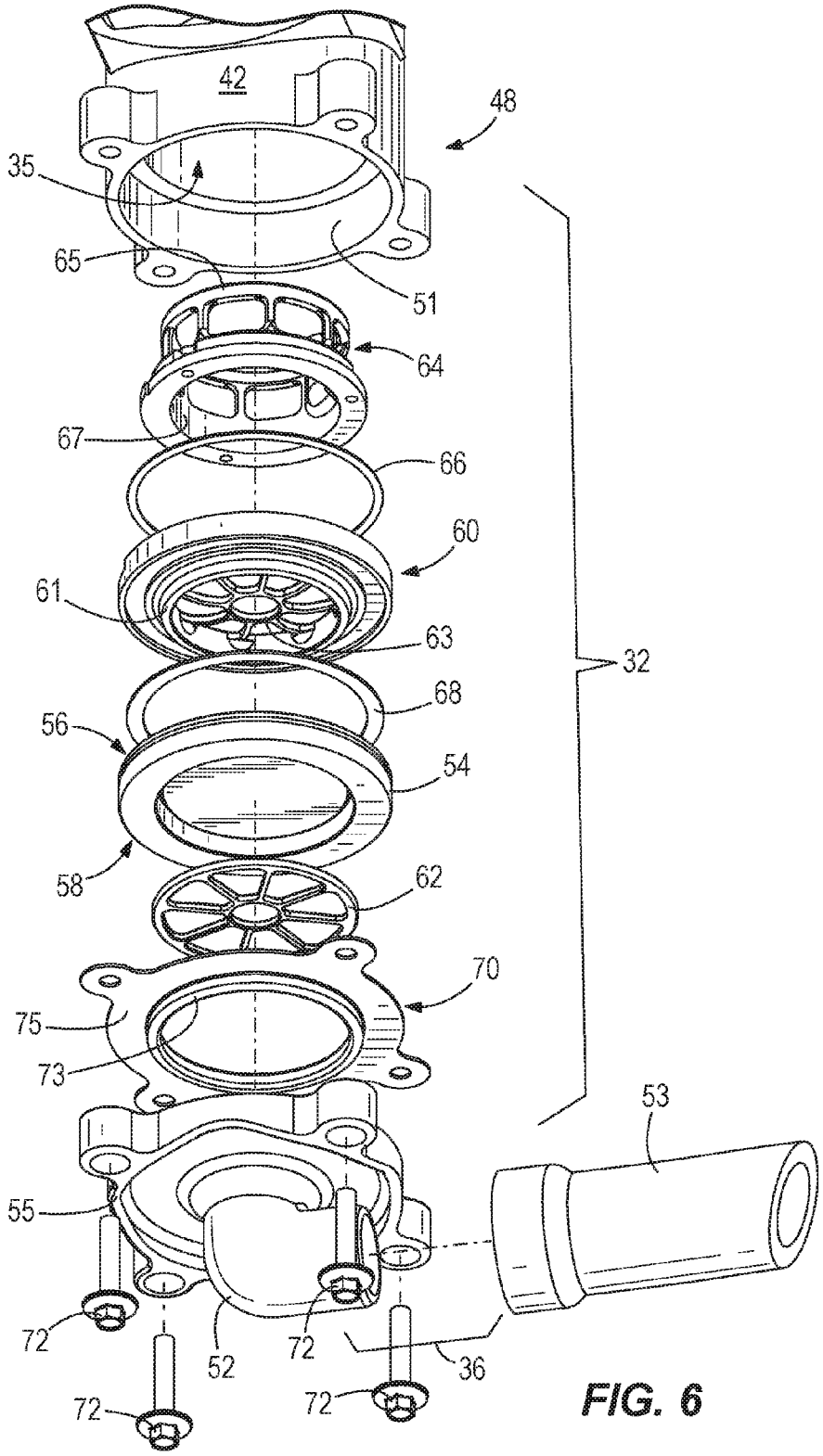
FIG. 6 illustrates an exploded view of the sound enhancement assembly of the present disclosure.

Now turning to FIGS. 5 and 6, the sound enhancement assembly 32 will be described in further detail. Both FIGS. 5 and 6 show the lower end 48 of the plenum 42. The lower end 48 of the plenum 42 is fashioned into the first mounting flange 51, which has a cylindrical inner opening or aperture 35. In an example in which the assembly housing connection to the sound enhancement assembly 32 is located at a different portion of the air intake assembly, or on a different type of air intake structure, the first mounting flange 51 might take other shapes, sizes, and/or forms than that shown herein. An inlet pipe 34 coupled to the intake structure 24 collects sounds emitted by the engine and directs the sounds into the assembly housing 47. Here, the inlet pipe 34 is made of two separate parts, 64 and 60, which will be described further herein below. The length and diameter of the inlet pipe 34 can be adjusted to provide a desired sound level and frequency response. The attachment location of the inlet pipe 34 and assembly housing 47 can be at any point along the intake path prior to the cylinder head 30, as mentioned, and can be selected based on a variety of factors, including complimentary frequency content of the sound intake present at the attachment location, level of the intake sound at the attachment location, packaging feasibility, airflow disruption, etc. The assembly housing 47 provides a seat for the remainder of the sound enhancement assembly 32 and should not allow intake air to escape from between the intake structure 24 and the sound enhancement assembly 32. For this and other purposes, the sound enhancement assembly 32 may include a sound enhancement device 54 (such as the flexible membrane shown herein) located within the assembly housing 47, which provides a fluid-tight seal between the sound enhancement assembly 32 and the air intake structure 24.

The sound enhancement device 54 acts as a passive speaker that is tuned to amplify a subset of sounds that have been collected from the area where the sound enhancement assembly 32 is coupled to the air intake structure 24. The sound enhancement device 54 adjusts the spectral frequency (sound amplitude vs. frequency) of the subset of sounds without the use of active components such as, for example, electronic amplifiers. Because the sound enhancement assembly 32 is passive, it relies on acoustic excitation of the sound enhancement device 54 by sounds radiating from the air intake structure 24 to provide amplification. This subset of sounds can be defined in any way desired by the manufacturer/installer/operator. For example, the subset of sounds may be sounds that have frequencies within a desired frequency range, such as those that produce what might be considered a pleasant "rumble" that conveys the power of the engine 14 to the operator of the vessel. The sound enhancement device 54 can be tuned to amplify this pleasant rumble such that the operator can hear it better.

In one example, the sound enhancement device 54 extends generally transversely across the aperture 35 (see FIG. 6) in a chamber located between the inlet pipe 34 and the outlet pipe 36, as will be described further herein below. The sound enhancement device 54 can have any sort of shape that will fill the cross-sectional shape of the aperture 35, and its outer edges can be sealed along an inner perimeter of the aperture 35 so as to isolate the remainder of the sound enhancement assembly 32 downstream of the sound enhancement device 54 from air flow in the interior of the air intake passageway. Thus, the sound enhancement assembly 32 is not a functional part of the air induction or exhaust system and does not supply air to or remove air from the engine 14. In general, the sound enhancement device 54 comprises some sort of spring/mass/damper system. The sound enhancement device 54 could be a flexible membrane, spring and disk, tuned plate, etc. For example, the sound enhancement device 54 can be a tuned element made of plastic or of a thin metal sheet attached to a spring that can be tuned to achieve desired frequency characteristics. The sound enhancement device 54 may take other forms, such as a trumpet. In the example where the sound enhancement device 54 is a membrane, the membrane may be made out of any sort of flexible or elastomeric substance, and in one example is a disc made out of rubber. A stiffness of the membrane can be tuned in order to provide a desired amount of amplification of the subset of sounds (the desirable sounds). The stiffness of the membrane can be varied by stretching the membrane tighter or allowing the membrane to be looser as it spans the aperture 35. Another way in which the acoustic flexure properties of the membrane may be tuned or adjusted is by varying the thickness (and therefore mass and stiffness) of the membrane. Additionally, the composition of the membrane itself and/or products that are applied to the membrane can cause it to exhibit different characteristics upon application of sound waves.

The sound enhancement assembly 32 also includes the above-noted outlet pipe 36. The outlet pipe 36 has an upstream end, here designed as the elbow piece 52 having the second mounting flange 55, which is coupled to the first mounting flange 51 downstream of the sound enhancement device 54. The outlet pipe 36 also includes a downstream pipe 53 coupled to the elbow piece 52 that transmits the amplified subset of the collected sounds to an area outside of the cowl 12, 13. The downstream end of the outlet pipe 36 is located proximate an outer surface of the upper or lower portions of the cowl 12, 13 (FIG. 2), so as to deliver the amplified subset of collected sounds to the area outside of the cowl 12, 13. In the example shown in FIG. 2, the downstream end of the outlet pipe 36 ends just outside of the cowl 12, 13, but it could be provided to extend further through the cowl 12, 13 or to end just inside the cowl. In one example, the downstream end of the outlet pipe 36 is coupled to the lower portion 13 of the cowl (i.e. the chaps), which is not required to be removed for servicing the engine 14. (Generally, only the upper portion 12 is removed during routine engine servicing.) Further, in the example shown in FIG. 2, the downstream end of the outlet pipe 36 is positioned at a front side of the outboard motor 10. In contrast, the air vent 18 is positioned at the back side of the outboard motor 10. As mentioned above, this allows unpleasant mechanical or air intake noises to exit the cowl 12, 13 remote from the operator. The amplified pleasant sounds exit the cowl 12, 13 closer to the operator. The subset of sounds (shown by the arrow labeled "S1"), which have been collected and amplified by their passage through the sound enhancement assembly 32, are directed toward the operator of the outboard motor, as they are emitted from the front side of the outboard motor 10. Meanwhile, the sounds "S2" that are not in the subset "S1" (i.e., sounds that do not have the desired frequency) are emitted via the vent 18, which, because it is located on the back side of the outboard motor 10, directs the undesired sounds away from the operator. Thus, the operator can better hear the amplified, desirable sounds than he or she can hear the non-amplified remainder of the sounds.

Returning to FIGS. 5 and 6, the sound enhancement assembly 32 further includes a tensioner 60 that maintains a given tension of the sound enhancement device 54. An inner circumference of a lip 61 that extends down on the bottom of the tensioner 60 acts as the lower half of the inlet pipe 34. The height of the lip 61 of the tensioner 60 stretches the sound enhancement device 54 to a desired stiffness. The final tension of the sound enhancement device 54 is set by the clamp load of the assembly housing 47 compressing the outer (rigid) ring of the sound enhancement device 54 into its final position, thereby stretching the sound enhancement device 54 over the lip 61 on the tensioner 60. Here, the tensioner 60 has a central spine molded as the inner diameter of the part that acts as an integral travel guard 63, such that the assembly housing 47 includes at least one travel guard 63, 62 on at least one of an upstream side 56 and a downstream side 58 of the sound enhancement device 54. The at least one travel guard 63, 62 prevents the sound enhancement device 54 from distending by more than a predetermined distance in response to a pressure pulse. For example, the upstream travel guard 63 comprises a suspended central spine that prevents against over travel of the sound enhancement device 54 in case of an event creating a sudden intake manifold vacuum outside of typical steady state operating conditions, such as for example throttle chop. A downstream travel guard 62 is placed between the sound enhancement device 54 and the elbow piece 52 of the outlet pipe 36 to prevent over travel in case of an event creating a sudden intake manifold increase in pressure outside of typical steady-state operating conditions, such as for example backfire.

The spacing of each travel guard 63, 62 is set to prevent contact between the sound enhancement device 54 and the travel guards 63, 62 under typical steady-state operating conditions. This can be a number of millimeters, such as for example 5 millimeters, but depends on the desired steady state movement of the sound enhancement device 54 in response to sound pressure pulses in the air intake system. Although the tensioner 60 and downstream travel guard 62 are shown herein as comprising circular disks having central circular spines and support arms that radiate from the central circular spine to an outer edge of the disk, other shapes and configurations for the tensioner 60 and downstream travel guard 62 could be provided. The support arms are spaced apart such that sound pressure pulses in the plenum 42 can act on the sound enhancement device 54 and amplified sound pressure pulses created by the sound enhancement device 54 can travel unhindered to the outlet pipe 36. The tensioner 60 and downstream travel guard 62 can be made from a reinforced polymer or alternative materials. Ideally, the materials of the tensioner/travel guard are not elastic and do not vibrate in response to sound pressure pulses within the system. Thus, both of the tensioner 60 and downstream travel guard 62 are acoustically transparent and do not significantly affect the sounds traveling through the sound enhancement assembly 32.

The sound enhancement assembly 32 may also include an acoustically transparent shield 64 including an upper domed roof 65 positioned above a lower tubular portion 67 of the shield 64 that makes up a portion of inlet pipe 34. The shield 64 is located upstream of the sound enhancement device 54 and protects the sound enhancement device 54 from particulates in the intake structure 24 (i.e., plenum 42). This prevents the sound enhancement device 54 from accumulating unwanted substances, which is especially useful if the sound enhancement assembly 32 is positioned vertically within the intake structure 24. Here, the shield 64 comprises the above-mentioned lower tubular portion 67 that sits atop the outer flange and lip 61 of the tensioner 60 and fits into the inner diameter of the first mounting flange 51. A number of circumferentially-spaced columns 69 extend upwardly from the lower tubular portion 67 and support the upper domed (or conical) roof 65 that extends into the plenum 42 and sheds any particulates that settle on it. The columns 69 are spaced apart such that sound pressure pulses in the plenum 42 can act on the sound enhancement device 54. Of course, other constructions for the shield 64 are within the scope of the present disclosure. The shield 64 could be made of a reinforced polymer or other materials. Ideally, the material of the shield 64 is not elastic, does not vibrate in response to sound pressure pulses within the system, and thus does not have a significant effect on the sounds emitted from the sound enhancement assembly 32.

In this example, the tensioner 60 and the shield 64 each have a cylindrical inner diameter that together form the inlet pipe 34. Tensioner 60 has an inner diameter defined by lip 61 that defines the lower half of the inlet pipe 34, and shield 64 has an inner diameter defined by tubular portion 67 that defines the upper half of the inlet pipe 34. The length of this inlet pipe 34 is dictated by the sum of the heights of the openings in both the tensioner 60 and the shield 64, and the diameter of the inlet pipe 34 is dictated by the inner diameter of these two parts. In this embodiment, in order adjust the physical dimensions of the inlet pipe 34 such as its length and diameter, these two components 60, 64 would require modification. This is potentially a desirable tuning parameter for the sound enhancement assembly 32.

An O-ring 66 may be provided between the shield 64 and the tensioner 60 in order to seal the tensioner 60 to the first mounting flange 51. An optional tension adjustment ring 68 may be provided between the tensioner 60 and the sound enhancement device 54. This tension adjustment ring 68 is a tuning component that can be provided with different thicknesses in order to stretch the sound enhancement device 54 to different tensions for alternative tuning frequencies. The thickness of the tension adjustment ring 68 adjusts the effective height of the lip 61 on the primary tensioner 60, allowing for various tension settings for the sound enhancement device 54. For example, a thinner tension adjustment ring 68 would effectively create a longer lip 61 and thus cause the sound enhancement device 54 to be stretched tighter across the aperture 35. See FIG. 5.

A seal 70 is provided between the downstream side 58 of the sound enhancement device 54 and the outlet portion of the assembly housing 47 (i.e., elbow piece 52). The seal 70 is preferably made of a compressible material in order to provide an airtight seal between the first mounting flange 51 and the second mounting flange 55 on the elbow piece 52. The seal 70 has an inner ring-shaped circumference 73 that holds the outer circumference of the downstream travel guard 62 therein. The seal 70 also has an outer flange 75 for holding the seal 70 to the remainder of the sound enhancement assembly 32. The elbow piece 52 and seal 70 are held to the inlet portion of the assembly housing 47 (first mounting flange 51) by way of one or more fasteners, such as the bolts 72 shown herein, that pass through holes in their respective flanges 55, 75 and into corresponding holes surrounding the aperture 35 in the first mounting flange 51.

The downstream pipe 53 of the outlet pipe 36 can be friction fit over the downstream end of the elbow piece 52. In another example, the outlet pipe 36 is integrally formed from the second mounting flange 55 that sits against the seal 70 and is bolted to the first mounting flange 51 all the way to the downstream end that exits the cowl 12, 13. In another example, the outlet pipe 36 includes a separate or integral flanged piece that is other than an elbow shape. The elbow piece 52 serves as the outlet portion of the sound enhancement assembly housing 47. The outlet portion needs an attachment connection for the outlet pipe, which in this example happens to be a 90 degree elbow. This outlet pipe attachment could instead be oriented at any angle, and its shape could be selected in order to provide ease of routing to the desired outlet location at the cowl. The inner diameter of the outlet pipe 36 is a tuning parameter for the sound enhancement assembly 32, and this could be adjusted to any diameter. Note that the outlet pipe 36 could also be provided with twists, turns, and varying diameters before it exits the cowl 12, 13. This can allow the outlet pipe 36 to snake around other engine components, or can provide different characteristics to the sound emitted from the outlet pipe 36.

For example, the outboard motor 10 shown in FIGS. 2-6 can also be designed to attenuate a second subset of the sounds emitted from the engine 14. This second subset of sounds may have frequencies that are within an undesired frequency range. For example, these may be sounds having a frequency that might be considered annoying to the operator of the outboard motor 10. In order to attenuate the second subset of sounds, the length and/or shape of outlet pipe 36 can be selected specifically to provide a desired amount of attenuation. Alternatively or additionally, a stiffness of the sound enhancement device 54 can be tuned to provide a desired amount of attenuation of the second subset of sounds. Additionally or alternatively, a sound attenuating device may be provided within the outlet pipe 36 so as to provide a desired amount of attenuation of the second subset of sounds. The sound attenuating device could be a small fibrous pad, another type of padded material, foam inserts, or a similar spongey-type material that is designed to attenuate certain frequencies of sounds. Optionally, tube wall compliance (elasticity) can be used to provide additional damping. Therefore, the system provides enhancement of desirable engine sound characteristics, while minimizing unwanted sounds that radiate from cowl openings. By suppressing unwanted sounds and highlighting desirable sounds, a more refined sound quality can be obtained.

Figure 7:
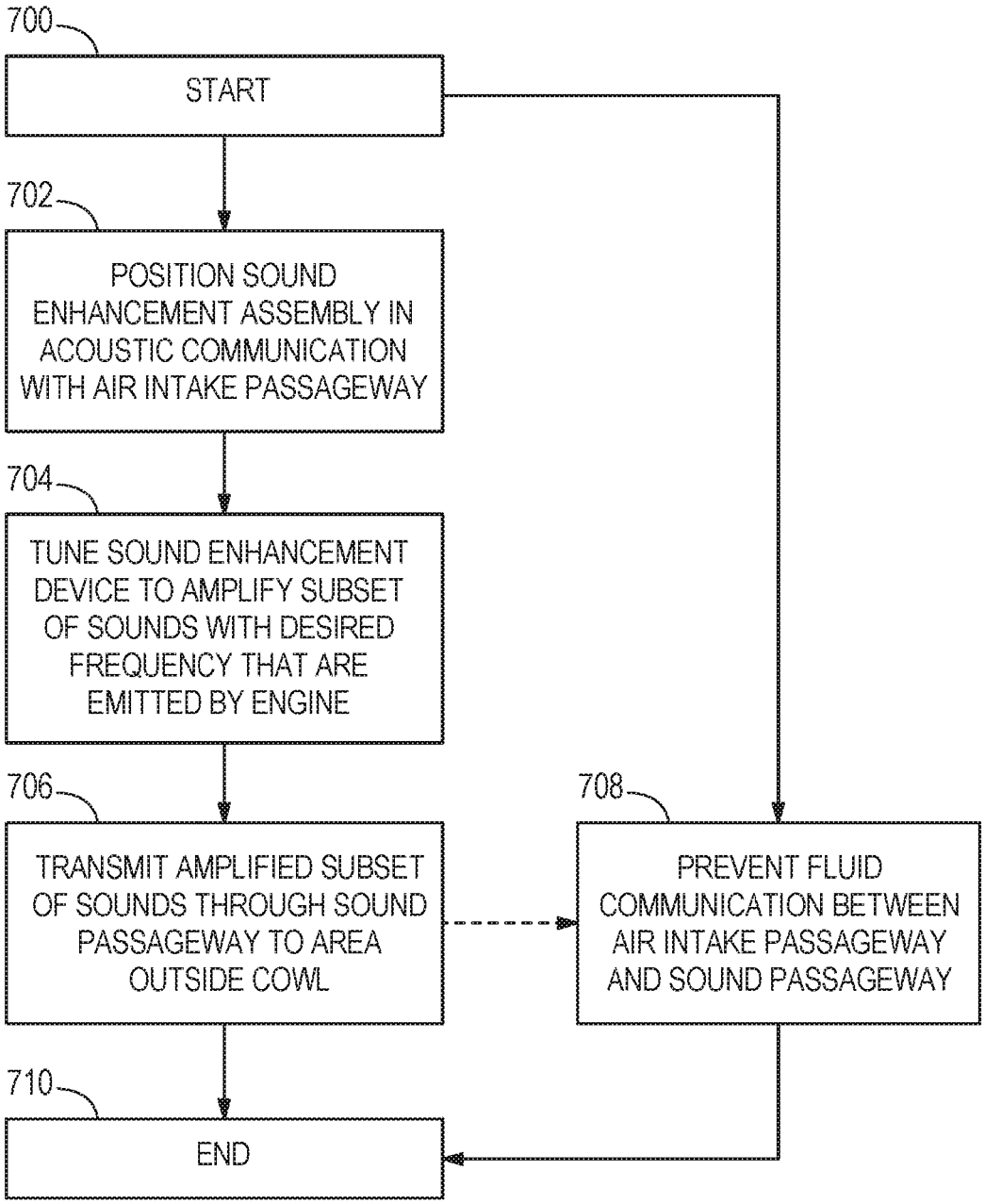
FIG. 7 illustrates one method for enhancing sounds produced by an engine according to the present disclosure.

Now turning to FIG. 7, a method for modifying sounds produced by an air intake system of an internal combustion engine 14 powering an outboard motor 10 will be described. The method begins at start 700. Next, as shown at 702, the method includes positioning a sound enhancement assembly 32 in acoustic communication with an air intake passageway located downstream of a throttle body 16 of an engine 14. In one example, the air intake passageway may be defined by a plenum 42 (e.g., an air intake manifold) downstream of the throttle body 16 and one or more intake runners 44*a*-44*d* extending from the plenum 42 to one or more combustion chambers 20 of the engine 14. As shown at 704, the method may further include tuning a sound enhancement device of the sound enhancement assembly 32 so that the sound enhancement device amplifies a subset of sounds emitted by the engine 14 that have frequencies within a desired frequency range. As described herein above, the sound enhancement device 54 may comprise a flexible membrane. In the example where sounds are collected by an inlet pipe 34 coupled to the air intake passageway, the method may further include placing the sound enhancement device 54 (membrane) in an assembly housing 47. The method may further include placing the sound enhancement device 54 across an inner diameter of the assembly housing 47 and maintaining a desired tension on the sound enhancement device 54 by contacting it with a tensioner 60. Further tensioning adjustment may be provided, for example, by way of a tension adjustment ring 68 fitted between the sound enhancement device 54 and the tensioner 60.

Further, the method may also include providing at least one travel guard 63, 62 in the housing that prevents the sound enhancement device 54 from distending by more than a predetermined distance in response to a pressure pulse, such as that created by backfire or throttle chop. The method may include providing a first travel guard 63 (for example, integral with the tensioner 60) on an upstream side 56 of the sound enhancement device 54 and a second travel guard 62 on a downstream side 58 of the sound enhancement device 54. The method may further comprise shielding the sound enhancement device 54 from particulates in the intake passageway, such as by way of shield 64, as described herein above with respect to FIGS. 5 and 6.

Returning to FIG. 7, as shown at 706, the method may include transmitting the amplified subset of sounds as sound pressure pulses through a sound passageway of the sound enhancement assembly 32 to an area outside a cowl 12, 13 covering the engine 14. For example, the method may include connecting an outlet pipe 36 to the assembly housing 47 downstream of the sound enhancement device 54, wherein the outlet pipe 36 defines the sound passageway. The method may further include, as shown at 708, preventing fluid communication between the air intake passageway and the sound passageway. This portion of the method in effect occurs simultaneously to the remainder of the portions of the method, as fluid communication between the air intake passageway and the sound passageway is prevented by provision of the sound enhancement device 54 that extends across the inner diameter of the assembly housing 47. The sound enhancement device 54 does not allow air to pass through it. In other words, sound pressure pulses on an upstream side 56 of the sound enhancement device 54 cause the sound enhancement device 54 to vibrate and create amplified sound pressure pulses on a downstream side 58 of the sound enhancement device 54 in air that is not in communication with air on the upstream side 56 of the sound enhancement device 54. This way, intake air is not released to the atmosphere through the sound passageway. The sound enhancement assembly 32 is therefore not a part of the air intake flow path and does not provide air to the combustion chambers 20 nor does it convey air away from the combustion chambers 20 that should otherwise be provided for combustion. The method concludes at 710.

Optionally, a sound throttle can be used to control the volume contribution of the amplified sound coming from the sound enhancement assembly 32. For example, see element 74 in FIG. 2. The sound throttle 74 may be a butterfly valve located between the attachment location of the sound enhancement assembly 32 to the air intake structure 24, such as just upstream of the inlet pipe 34, and can be of similar diameter to the inlet pipe 34. Alternatively, the sound throttle 74 can be placed between the shield 64 and the tensioner 60 or downstream of the sound enhancement device 54 at any position along the outlet pipe 36. The sound throttle 74 can be electronically controlled, with calibrated positions intended to deliver a target level of sound based on engine load. The sound throttle 74 can also be used to create a variety of intake sound profiles which can be selected by the user (for example, race, sport, quiet modes, etc.). Essentially, the sound throttle 74 works as a volume knob rather than changes the character of the sound produced by the sound enhancement assembly 32. For example, when wide open throttle speed is requested by the operator, the sound throttle 74 of the sound enhancement assembly 32 could be fully open. The sound throttle 74 could be closed or partially open for lighter load cases, such as when the engine 14 is operated at less than wide open throttle speed.

The sound enhancement assembly 32 of the present disclosure has an increased impact on the sound signature produced because the sound source (i.e. the inlet pipe 34 and sound enhancement device 54) can be located at a strategic point downstream of the throttle body 16. Note that when a sound enhancement device is placed upstream of the throttle body 16, pressure pulses from each combustion chamber 20 are more or less combined into a single noise source, meaning a device upstream of the throttle body 16 acts more like a volume knob for the intake sound that is already present. However, by locating the sound device downstream of the throttle body 16, there is a greater potential to locate, identify, and isolate noise contributions from different portions of the engine's air intake passageways. Additionally, attachment of the sound enhancement assembly 32 at various points along the intake passageway can create more packaging options, allowing the sound enhancement assembly 32 to be used with more outboard motor package types.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. An outboard motor comprising:

an internal combustion engine powering the outboard motor;

a cowl covering the engine and having a vent allowing air under the cowl;

a throttle body metering flow of the air into the engine;

an intake structure downstream of the throttle body that delivers the metered airflow to one or more combustion chambers in a cylinder block of the engine; and a sound enhancement assembly including an assembly housing, the sound enhancement assembly being in acoustic communication with the intake structure downstream of the throttle body and collecting sounds emitted by the engine;

wherein the sound enhancement assembly includes a sound enhancement device located within the assembly housing that is tuned to amplify a subset of the collected sounds that have frequencies within a desired frequency range.

2. The outboard motor of claim 1, wherein the sound enhancement assembly includes an inlet pipe coupled to the intake structure that collects the sounds emitted by the engine and directs the collected sounds into the assembly housing.

3. The outboard motor of claim 2, wherein the inlet pipe is coupled to the intake structure upstream of a cylinder head attached to the cylinder block of the engine.

4. The outboard motor of claim 2, wherein the sound enhancement assembly includes an outlet pipe having an upstream end coupled to the assembly housing downstream of the sound enhancement device, wherein the outlet pipe transmits the amplified subset of the collected sounds to an area outside the cowl.

5. The outboard motor of claim 4, wherein the sound enhancement assembly includes an acoustically transparent shield positioned above the inlet pipe upstream of the sound enhancement device that protects the sound enhancement device from particulates in the intake structure.

6. The outboard motor of claim 4, wherein a downstream end of the outlet pipe is coupled to a lower portion of the cowl.

7. The outboard motor of claim 4, wherein the intake structure defines a first passageway that is separate and distinct from a second passageway defined by the outlet pipe.

8. The outboard motor of claim 4, wherein the assembly housing comprises a first mounting flange that is integral with the intake structure and a second mounting flange that is integral with the upstream end of the outlet pipe, the first and second mounting flanges being connected to one another in an airtight manner.

9. The outboard motor of claim 2, wherein the sound enhancement device is a membrane, and further comprising a tensioner disk clamped within the assembly housing and stretching the membrane to maintain a given tension of the membrane.

10. The outboard motor of claim 9, further comprising at least one travel guard disk located in the assembly housing on at least one of an upstream side and a downstream side of the membrane that prevents the membrane from distending by more than a predetermined distance in response to a pressure pulse.

11. The outboard motor of claim 3, wherein the intake structure comprises a plenum downstream of the throttle body and one or more intake runners extending from the plenum to the one or more combustion chambers of the engine, and wherein the inlet pipe is coupled to the plenum.

12. A method for modifying sounds produced by an air intake system of an internal combustion engine powering an outboard motor, the method comprising:

positioning a sound enhancement assembly including an assembly housing in acoustic communication with an air intake passageway located downstream of a throttle body of the engine;

providing the acoustic communication downstream of the throttle body;

tuning a sound enhancement device of the sound enhancement assembly so that the sound enhancement device amplifies a subset of sounds emitted by the engine that have frequencies within a desired frequency range;

transmitting the amplified subset of sounds as sound pressure pulses through a sound passageway of the sound enhancement assembly to an area outside a cowl covering the engine; and preventing fluid communication between the air intake passageway and the sound passageway by providing a fluid-tight seal between the air intake passageway and the sound passageway.

13. The method of claim 12, further comprising collecting sounds emitted by the engine with an inlet pipe of the sound enhancement assembly, the inlet pipe being coupled to the air intake passageway so as to direct the collected sounds into the assembly housing.

14. The method of claim 13, wherein the sound enhancement device comprises a flexible membrane, and further comprising placing the membrane within the assembly housing and maintaining a given tension on the membrane by stretching the membrane with a tensioner disk.

15. The method of claim 13, further comprising providing at least one travel guard disk in the assembly housing that prevents the sound enhancement device from distending by more than a predetermined distance in response to a pressure pulse.

16. The method of claim 15, further comprising providing a first travel guard disk on an upstream side of the sound enhancement device and a second travel guard disk on a downstream side of the sound enhancement device.

17. The method of claim 13, further comprising providing a shield upstream of the sound enhancement device that shields the sound enhancement device from particulates in the air intake passageway.

18. The method of claim 13, further comprising connecting an outlet pipe to the assembly housing downstream of the sound enhancement device, wherein the outlet pipe defines the sound passageway.

19. The method of claim 12, wherein the air intake passageway is defined by a plenum downstream of the throttle body and one or more intake runners extending from the plenum to one or more combustion chambers of the engine.

* * * * *